US009441341B1

(12) United States Patent
Hames

(10) Patent No.: US 9,441,341 B1
(45) Date of Patent: Sep. 13, 2016

(54) TRENCH SHIELD SPREADER COUPLING

(76) Inventor: Gary Neil Hames, Keller, TX (US)

( * ) Notice: Subject to any disclaimer, the term of this patent is extended or adjusted under 35 U.S.C. 154(b) by 778 days.

(21) Appl. No.: 13/553,788

(22) Filed: Jul. 19, 2012

Related U.S. Application Data

(60) Provisional application No. 61/510,674, filed on Jul. 22, 2011.

(51) Int. Cl.
*E02D 17/08* (2006.01)

(52) U.S. Cl.
CPC ..... *E02D 17/08* (2013.01)

(58) Field of Classification Search
USPC ..... 405/282, 283; 403/292, 294, 298
See application file for complete search history.

(56) References Cited

U.S. PATENT DOCUMENTS

| | | | | | |
|---|---|---|---|---|---|
| 510,625 | A * | 12/1893 | Wright | 52/154 |
| 3,178,210 | A * | 4/1965 | Dickinson | 403/292 |
| 4,044,564 | A * | 8/1977 | Griswold | 405/283 |
| 4,056,938 | A * | 11/1977 | Griswold | 405/283 |
| 4,058,983 | A * | 11/1977 | Griswold | 405/283 |
| RE30,185 | E * | 1/1980 | Griswold | 405/283 |
| 4,949,525 | A * | 8/1990 | Weaver | 40/606.14 |
| 5,078,534 | A * | 1/1992 | White | 403/292 |
| 5,310,290 | A * | 5/1994 | Spencer | 405/283 |
| 5,741,091 | A * | 4/1998 | St. George et al. | 405/283 |
| 6,443,665 | B1 * | 9/2002 | Kundel, Sr. | 405/283 |
| 7,036,832 | B2 * | 5/2006 | Gargaro | 280/47.131 |
| 8,371,768 | B1 * | 2/2013 | Wu | 403/294 |
| 2008/0247831 | A1 * | 10/2008 | Worley | 405/283 |

FOREIGN PATENT DOCUMENTS

| | | | |
|---|---|---|---|
| SE | EP 0161634 | A2 * | 11/1985 |
| WO | WO 03066972 | A1 * | 8/2003 |

OTHER PUBLICATIONS

Author: Unknown Title: Excavations: Hazard Recognition in Trenching and Shoring Publication: OSHA Tech Manual; Section V, Chapter 2; Washington, DC, USA Effective Date: Jan. 20, 1999; Directive No. TED 01-00-015.

* cited by examiner

*Primary Examiner* — Victor MacArthur
(74) *Attorney, Agent, or Firm* — Guy V. Manning

(57) ABSTRACT

A coupling unites two short segments of trench shield spreader tubing into a single spreader tube of desired length. The coupling comprises a cylindrical insert adapted to fit snugly within and to extend a short distance into the interiors of two spreader tube segments abutted end-to-end, the total length of which becomes the spreader. Each coupling includes transverse retainer pin holes which align with like holes through the abutted ends of the spreader tube segments to admit a retainer pin. The coupling may include stiffener and spacer straps disposed on either side of the retainer pin holes that extend substantially the length of the coupling.

6 Claims, 2 Drawing Sheets

TRENCH SHIELD SPREADER COUPLING

This application is a continuation-in-part of, and claims priority to, a Provisional Application Ser. No. 61/510,674, filed Jul. 22, 2011.

BACKGROUND OF THE INVENTION

1. Field of the Invention

This invention relates generally to trench excavation and particularly to trench shields designed to protect workers from cave-ins while working in trenches. More particularly, this invention relates to a coupling for splicing two or more short trench shield spreader tube segments into a longer spreader tube of desired length.

2. Description of Related Art

Digging an open trench to a target depth in different types of soils requires varying degrees of slope angles and berm widths to meet safety standards of the United States Occupational Health and Safety Administration ("OSHA"). Where shoring is used, berms can be abbreviated and workers can enter trenches comparatively safely. Where shoring is not used, however, OSHA guidelines often require a trench shield to protect workers who venture down into the trench to complete its excavation, make adjustments or otherwise work at the bottom of the trench.

Trench shields comprise two vertical panels arrayed on opposite sides of a section of vertical wall trench to hold back a collapsed or sluffed ditch berm. The panels are separated by a plurality of spreaders that hold them in place juxtaposed to the ditch sides. See generally FIGS. 1 and 2. Trench shield spreaders typically comprise tubular steel cylinders of a length adapted to accommodate the trench width. Such tubing typically comes in standard lengths and must be cut to the desired length defined by the trench width, often leaving a fractional piece of tubing which usually is discarded. Made of high-grade steel to enable it to withstand significant longitudinal compressive forces from the trench walls, spreader tubing is quite expensive, and the cost of any trenching project necessarily must include significant wastage from discarded segments of spreader tubing. A need exists for means for using fractional segments of spreader tubing instead of discarding them.

SUMMARY OF THE INVENTION

A coupling unites two short segments of trench shield spreader tubing into a single spreader tube of desired length. The coupling comprises a cylindrical insert adapted to fit snugly within and to extend a short distance into the interiors of two spreader tube segments abutted end-to-end, the total length of which becomes the spreader. Each coupling includes transverse retainer pin holes which align with like holes through the abutted ends of the spreader tube segments to admit a retainer pin. The coupling may include stiffener and spacer straps disposed on either side of the retainer pin holes that extend substantially the length of the coupling.

BRIEF DESCRIPTION OF THE DRAWINGS

The novel features believed characteristic of the present invention may be set forth in appended claims. The invention itself, however, as well as a preferred mode of use and further objects and advantages thereof, will best be understood by reference to the following detailed description of an illustrative embodiment when read in conjunction with the accompanying drawings, wherein:

DESCRIPTION OF A PREFERRED EMBODIMENT

Figure 1:
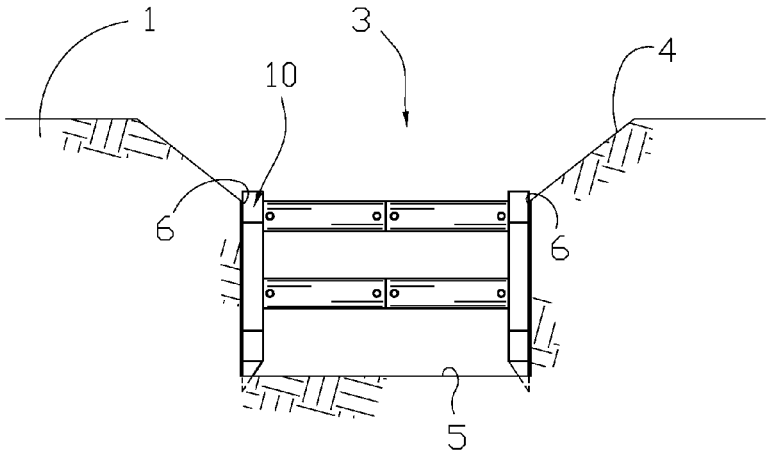
FIG. 1 shows a typical trench shield installation in a trench excavation.
Figure 2:
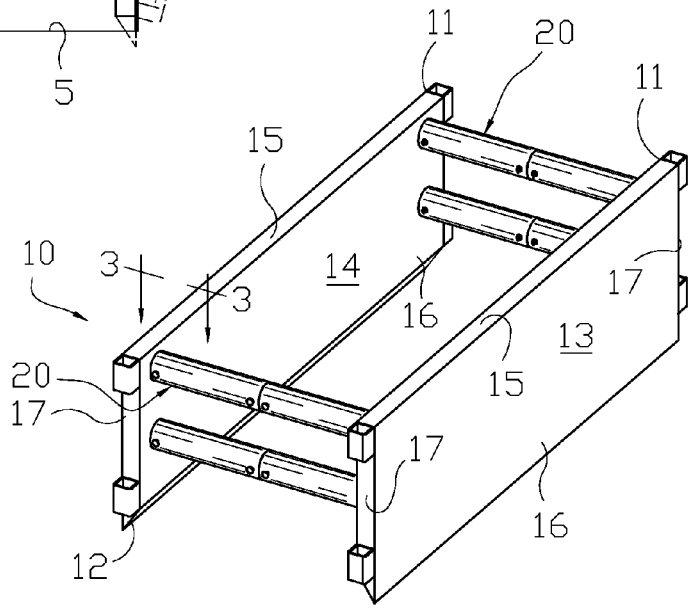
FIG. 2 shows in quartering perspective the trench shield of FIG. 1.
Figure 3:
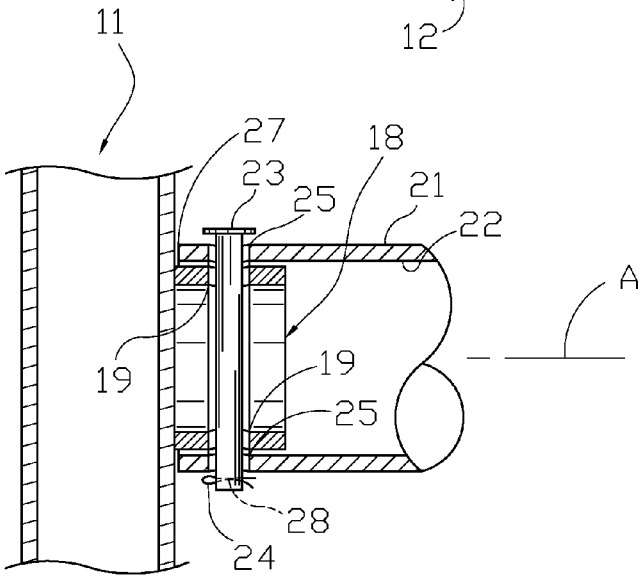
FIG. 3 depicts the manner in which each spreader tubing couples to the face of one of the panels of the trench shield of FIGS. 1 and 2.

Referring now to the figures, and particularly to FIGS. 1-3, conventional trench shield 10 installs within trench 3 between vertical trench walls 6. One each of a pair of shield panels 11 is disposed adjacent opposing trench walls 6, typically resting upon trench bottom 5. In contradistinction to trench shoring (not shown), which typically is hydraulically pressed against trench walls 6, trench shield 10 merely rests on bottom 5 to provide a cage within which workers (not shown) safely may enter trench 3 and work with minimal fear of collapse or sluffing of material from trench berm 4 or walls 6 which could injure or even bury them alive. As said workers move along the length of trench 3, shield 10 may be slid longitudinally (not shown) along bottom 5 to their new work site.

Shield 10 panels 11 are held at a fixed, horizontal separation from each other and substantially juxtaposed opposing trench walls 6 by a plurality of shield spreaders 20. Typically, four spreaders 20 are disposed, two each, near opposite ends 17 of panels 11 and toward top edge 15 thereof so as not to interfere with said workers while they occupy the space between panels 11. Each pair of spreaders 20 at one end 17 of panels 11 are stacked vertically, one above the other, to provide resistance to a potential transverse, rhomboidal collapse of shield 10 due to unbalanced pressure on outsides 13 of panels 11 by soil material from berm 4. Panels 11 may include beveled portions 12 along their bottom edge 16 that wedge under their own weight into the soil of trench bottom 5, further affixing the position and stabilizing the vertical orientation of panels 11.

As best seen in FIG. 3, each spreader 20 comprises cylindrical tube 21, typically of ovate, usually circular, cross section and defining hollow interior 22. One having ordinary skill in the art will recognize, of course, that other cross section shapes, such as square or rectangular, could be employed, with concomitant changes to the shapes of integrating pieces such as coupler 30, without departing from the spirit and scope of the present invention. Each end of tube 21 is cut evenly and normal to its longitudinal axis A to form perpendicular face 27 adapted to abut inside face 14 of panel 11. To retain face 27 in place, stud 18 protrudes a spaced distance outward from inside face 14 to journal within interior 22 of tube 21. Preferably, the length of stud 18 is approximately one and one-half (1½×) times its diameter, but one having ordinary skill in the art will recognize that the length of stud 18 is not critical as long as it is sufficiently long to include enough metal between its proximate end adjacent panel 11 and its distal end to support retainer pins 23 in pin holes 19, as discussed in more detail below. The outside diameter of stud 18 is selected to journal within interior 22 of tube 21 substantially snugly. One having ordinary skill in the art will recognize, however, that some play between stud 18 and interior 22 is desirable, as shield 10 comprises very heavy materials and is assembled using mechanical assistance means such as cranes. Thus, a low-tolerance fit between stud 18 and interior 22 is preferred over a tight fit.

Retainer pin apertures, or holes 19, are disposed on diametrically opposite sides of the circumference of stud 18, and preferably substantially horizontally (when panels 11 are in their installed orientation, as in FIG. 2) so that retainer pins 23 remain in place once inserted until keeper 24 can be installed. Retainer pin holes 19 are displaced longitudinally along stud 18 from panel surface 14 a spaced distance, substantially matching the displacement of like pin apertures, or holes 25, from faces 27 of spreaders 20. Thus, when tube face 27 abuts panel face 14, and tube 21 is angularly displaced around axis A to the appropriate angle, stud retainer pin holes 19 and spreader pin holes 25 align and define a path though which retainer pin 23 may be inserted.

Pin 23 preferably comprises a solid, cylindrical bar of cold rolled steel bearing pin head 26 on one end and including transverse pin keeper hole 28 at its opposite end distal pin head 26. Pin 23 is sufficiently long to extend all the way through spreader pin holes 25 and a spaced distance beyond the outside diameter of tube 21 so that pin keeper hole 28 is exposed sufficiently to enable installation of keeper 24. Keeper 24 retains pin 23 within pin aperture 25 to assure that pin 23 remains in place and prevents spreader 20 from separating from stud 18 and thereby panels 11.

Tube face 27 abuts and bears against inner panel face 14 so that force exerted on outside face 13 of panel 11 is transmitted mechanically through spreader 20 to opposite panel 11 and thereby into opposite trench wall 6 for support. Thus, though tube 21 fits snugly around stud 18, it does not depend significantly for stability upon resistance from stud 18 to moment forces induced in spreader 20 under such loading. Stud 18 is sufficiently strong, however, to resist lesser moment forces that may occur during installation and relocation of shield 10 as it typically is assembled outside of trench 3 and lifted into and out of place with a crane (not shown). Because spreaders 20 engage panel faces 14 in two vertically separated locations, shield 10 remains geometrically stable with spreaders 20 substantially perpendicular to panels 11, thereby forming a stable, rectangular cage for said workers.

Figure 4:
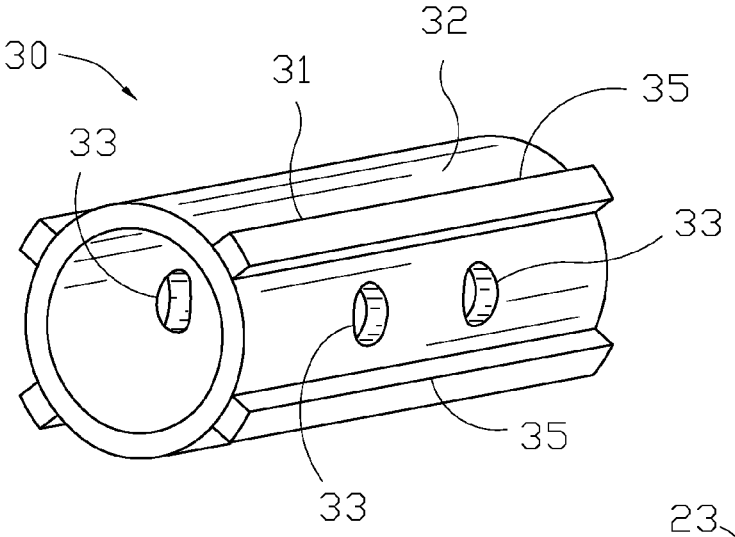
FIG. 4 shows in quartering perspective the spreader tube coupler of the present invention.
Figure 6:
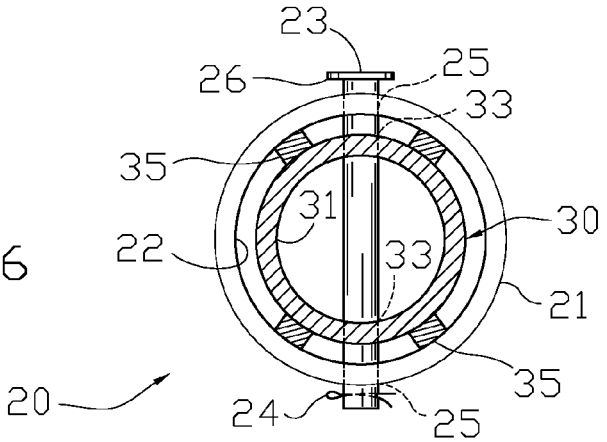
FIG. 6 depicts in end section view as indicated in FIG. 5 the coupler of the present invention as it nests inside the interior of one of the two segments of the spreader of FIG. 5.
Figure 5:
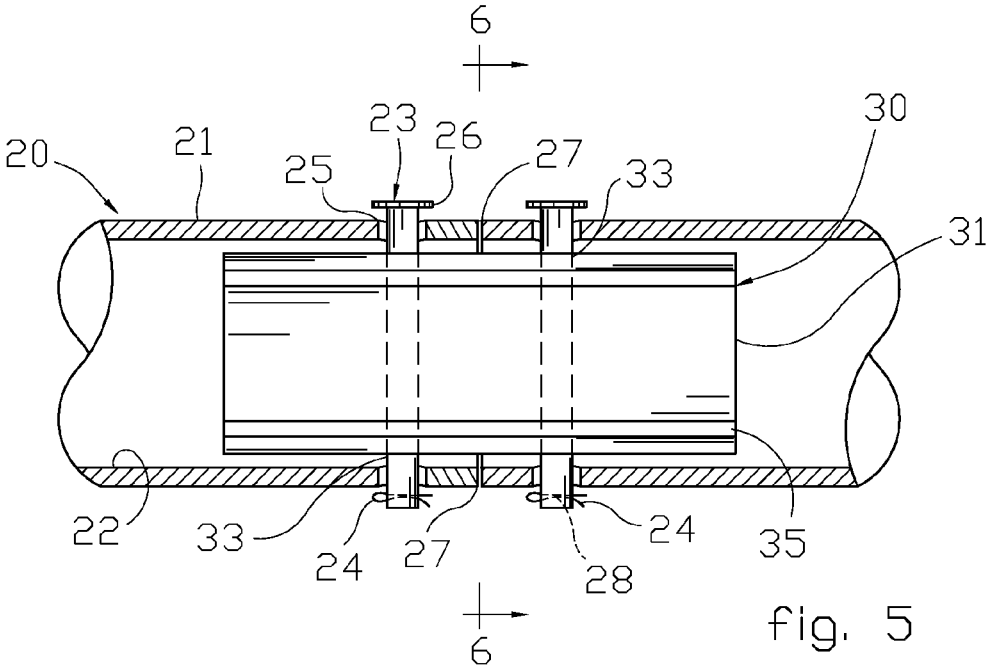
FIG. 5 shows in longitudinal cross section the spreader coupler of the present invention uniting two spreader tube segments to create a spreader for the trench shield of FIGS. 1 and 2.

Turning now also to FIGS. 4-6, the present invention comprises cylindrical coupler 30 adapted to insert within interiors 22 of two abutted segments of tube 21 selected to make up one spreader 20. Preferably, coupler 30 fits within interior 22 with substantially the same fit tolerance as stud 18. Coupler 30 extends longitudinally into each tube 21 approximately equidistantly and sufficiently far to support additional retainer pins 23 that hold faces 27 of tubes 21 juxtaposed. The spacing between two longitudinally aligned coupler pin ducts, or holes 33, in coupler 30 is approximately twice the distance each spreader pin hole 25 is displaced longitudinally from face 27 of tube 21. Thus, when coupler 30 is installed within interiors 21 of two abutted tubes 21, with pins 23 in place, faces 27 of adjacent tubes 21 bear against each other just as opposite faces 27, distal coupler 20, bear against panel faces 14, as discussed above. Accordingly, during loading, no significant forces bear against pins 23 within couplers 30.

Preferably, coupler 30 comprises a short segment of high-grade steel coupler body tubing 32, such as oil well drill stem, having a circular cross section and a diameter substantially equivalent to the diameter of stud 18. One having ordinary skill in the art will recognize, of course, that coupler body 32 could comprise a solid, cylindrical mass of material, instead of tubing, without departing from the spirit and scope of the present invention. Some play between coupler 30 and interior 22 also is desirable for assembly, but less so than between stud 18 and interior 22. This is because any remaining play allows two abutted segments of tubing 21 to develop a sag point as they span between panels 11 of assembled shield 10. It is expedient to minimize such sag, as it could create a weak point in spreader 20 that would be absent for a continuous, unbroken segment of tubing 21.

Accordingly, the present invention also includes spacers, or stiffeners 35 disposed longitudinally along its outside diameter of coupler body 32 and angularly displaced from pin holes 33. Stiffeners 35 extend to a diametrical height above the outside surface of coupler body 32 to engage the inside surface of interior 22 of tube 21. Stiffeners 35 preferably are displaced around the perimeter of coupler 30 so that they keep coupler 30 substantially coaxial with tube 21 by displacing all sides of coupler body 32 from the inside surface of tube 21 substantially the same amount. At least three, but preferably four stiffeners 35 are provided and disposed in diametrically opposing pairs on opposite sides of coupler body 32, though one having ordinary skill in the art will recognize that these pairs need not necessarily be displaced from each other a full quarter of the circumference of coupler body 32. The angular width of each of stiffeners 35 is not critical, but preferably it is approximately 150%-200% of the diametrical height of stiffeners 35.

In operation, assembly workers (not shown) select two segments of tube 21 which together extend for the desired length of spreader 20. For each trench shield 10, four such spreaders 20 of substantially equal length are selected, but one having ordinary skill in the art will recognize that the lengths of the two segments of tubing 21 that make up one spreader 20 need not match the lengths of the two other segments of tubing 21 that make up the other spreaders 20 as long as together each pair of segments of tubing 21 is of substantially the same length when assembled using couplers 30.

Said assembly workers then inspect the ends of each segment of tubing 21 to see that its faces 27 are perpendicular to its longitudinal axis A and to see whether or not one end thereof already includes pin holes 25 for interfacing with either stud 18 or coupler 30. Typically, at least one end, and likely both ends, of each segment of tubing 21 will not already have pin holes 25, as the selected segments of tubing 21 likely will have been chosen from a stock of discarded remnants of previously cut standard lengths of tubing 21 from which other spreaders 20 of non-standard length previously were made. In many cases, however, at least one end of said segments of tubing 21 already will have pin holes 25.

Thus, said assembly workers first may have to measure and cut pairs of diametrically opposing pin holes 25 in at least one end of said selected segments of tubing 21. Said assembly workers cut one pair of said pin holes 25 through the walls of tubes 21 a spaced distance longitudinally away from faces 27 to match pin holes 19 of stud 18, and another pair of pin holes 25 in the opposite end of said selected segments of tubing 21 to match the displacement of coupler pin holes 33 from the ends of coupler 30. Preferably, of course, the displacement of this second set of pin holes from faces 27 is the same as the first, but one having ordinary skill in the art will recognize that this is not required as long as one set of pin holes 25 in one end of each segment of tubing 21 matches stud 18 while the opposite pair matches pin holes 33 of coupler 30. Further, preferably, both sets of pin holes 25 are angularly displaced equally around the circumference of one segment of tubing 21 so that when installed on stud 18, both retaining pins 23 will be horizontal.

Once all segments of tubing 21 are prepared as described above, four couplers 30 are selected that match interior 22 of tubing 21. One each of said four couplers 30 then is aligned longitudinally and inserted a spaced distance into interior 22 of one of each pair of segments of tubing 21 to longitudinally align pin holes 25, 33. Coupler 30 then is rotated angularly as necessary to align pin holes 25, 33. If necessary, soap or other lubricant may be employed to facilitate this alignment process, but preferably enough slack remains, despite the presence of stiffeners 35, that lubricant is not needed. Once pin holes 25, 33 are aligned both longitudinally and angularly, pin 23 is inserted through pin holes 25, 33 and keeper 24 installed through keeper hole 28 to hold pin 23 in place.

Next, the second of said selected pair of segments of tubing 21 is journaled around the opposite end of coupler 30 with its face 27 abutted against face 27 of the first segment of tubing 21. Ideally, this causes pin holes 25 of the second segment of tubing 21 to align longitudinally with the second set of coupler pin holes 33. Said assembly workers then rotate the second segment of tubing 21 to angularly align pin holes 25, 33 and install another retainer pin 23 and keeper 24, thus completing one spreader 20 for shield 10. The foregoing steps are repeated as necessary to create four spreaders 20, readying shield 10 for conventional assembly and installation within trench 3. Once shield 10 no longer is needed, the foregoing steps may be reversed to disassemble the constituent parts for more efficient storage, or spreaders 20 may be left together using couplers 30 for stocking a given length of spreader 20 for future use.

As mentioned above, coupler 30 preferably comprises a regular, cylindrical segment of tubing modified as described. One having ordinary skill in the art will recognize that the material selected for coupler 30 could comprise one selected from a number of materials, as long as it is of sufficient moment strength to support the junction of said pair of segments of tubing 21 for the intended application. For example, in the application described herein, coupler 30 must have sufficient moment strength to create spreader 20. Such moment strength may be somewhat greater than required for stud 18, as any slack whatsoever between coupler 30 and interior 22 will result is some sag, however small, along the longitudinal length of spreader 20. When longitudinally compressive force is transmitted from one of said panels 11 toward the other through spreader 20, to the extent that there is any sag at the interface between said pair of segments of tubing 21, a significant moment force may occur, tending to bend coupler 30 at the sag point. Coupler 30 therefore must be of sufficient strength to resist such moment force. Accordingly, a preferred material for coupler 30 for the trench shield spreader 20 discussed herein comprises Schedule 40 carbon steel available generally as steel tubing from suppliers such as Shilling Brothers Pipe Company of Fort Worth, Tex. Alternate suitable materials for coupler 30 could include high density plastic, fiber-reinforced plastic, modified thermoplastics, glass-reinforced plastics, glass-reinforced thermoset polyesters, aluminum, stainless steel, resin reinforced laminates, nickel, cold rolled steel, cast iron, copper, steel alloy, brass or, as discussed above, hardwood. The choice between these materials depends upon the anticipated moment strength required, as discussed above.

Likewise, stiffeners 35 preferably comprise lengths of steel bar welded or otherwise attached by appropriate means to the exterior surface of coupler 30, but one having ordinary skill in the art will recognize that stiffeners 35 instead could be fabricated integrally with coupler body 32.

While the invention has been particularly shown and described with reference to preferred and alternate embodiments, it will be understood by those skilled in the art that various changes in form and detail may be made therein without departing from the spirit and scope of the invention. For example, though described for use in the trenching industry, coupler 30 may be employed in any industry where mechanical coupling of two tubular strut segments with minimal sag potential is desirable.

Further, though described above as comprising only one pair of segments of spreader tubing 21, spreaders 20 could of course be made up of three or more shorter segments, with a corresponding increase in the number of couplers 30 employed (one fewer couplers 30 than segments of tubing 21).

Further still, though described above as having simple pin holes 33 bored through coupler tube 32, coupler 30 could include guide bushings (not shown) surrounding pin holes 33 and extending radially inward into the interior of coupler body 32 a short distance to assist and guide insertion of retainer pins 23 toward and through opposite pin holes 33. Alternately, a sleeve (not shown) extending all the way across the interior of coupler body 32 could be employed to connect opposing pairs of pin holes 33, thereby further abetting insertion of retainer pins 23.

Further still, pin holes 33 have been described as substantially round and having a diameter substantially equivalent to that of pin holes 25 of spreader tubes 21. To assist assembly, and to compensate for variances in the longitudinal location of pin holes 25, coupler pin holes 33 could be fabricated as oval (not shown) instead of round apertures. Preferably, such oval pin holes 33 would have a long axis parallel to the longitudinal axis of coupler body 32 and a length of approximately twice their width, or twice the diameter of a circular pin hole 33.

I claim:

1. A coupler for trench shield spreaders, said trench shield having a pair of trench shield panels each disposed opposite the other adjacent opposite sides of a trench and held in position by a plurality of said trench shield spreaders, each of said spreaders having a plurality of spreader tubes disposed end-to-end, each spreader tube having a spreader tube longitudinal axis and a spreader tube diameter and surrounding and defining a spreader tube interior, each of said spreader tubes further surrounding and defining diametrically opposing pairs of transverse tube retainer apertures having aperture diameters and disposed a spaced distance from each spreader tube end, the coupler comprising a substantially cylindrical coupler body adapted to be journaled coaxially within and extending a spaced distance into said spreader tube interiors of two adjacent spreader tubes, said coupler body having a coupler body longitudinal axis extending between a first coupler body end and a second coupler body end to define a coupler body length, each coupler body end surrounding and defining a pair of diametrically opposing, transverse coupler body apertures adapted to align with said retainer tube apertures; and a plurality of diametrically opposing pairs of spacer bars disposed on an outside of said coupler body extending parallel said coupler body longitudinal axis a spaced distance along said coupler body length, said spacer bars adapted to reduce a diametrical gap between said coupler body and an inside surface of said spreader tube interior, thereby to urge said adjacent spreader tubes into substantially coaxial alignment; and means for securing said coupler body within each of said spreader tubes.

2. The coupler of claim 1 wherein said means for securing comprises two retainer pins, one each of said retainer pins adapted to cooperate with said opposing pair of retainer tube apertures and said pair of coupler body apertures of one of said two adjacent spreader tubes to affix said coupler body in a predetermined longitudinal position within each of said spreader tubes.

3. The coupler of claim 2 wherein said retainer pin further comprises a retainer pin extending between a proximate first pin end and a distal second pin end, said second pin end surrounding and defining a transverse pin keeper duct;

a retainer pin head disposed on said first pin end; and a pin keeper adapted removably to be journaled within said pin keeper duct.

4. A coupler for trench shield spreaders, said trench shield having a pair of trench shield panels each disposed opposite the other adjacent opposite sides of a trench and held in position by a plurality of said trench shield spreaders, each of said spreaders having a plurality of spreader tubes disposed end-to-end, each spreader tube having a spreader tube longitudinal axis and a spreader tube diameter and surrounding and defining a spreader tube interior, each of said spreader tubes further surrounding and defining diametrically opposing pairs of transverse tube retainer apertures having aperture diameters and disposed a spaced distance from each spreader tube end, the coupler comprising a substantially cylindrical coupler body adapted to be journaled coaxially within and extending a spaced distance into said spreader tube interiors of two adjacent spreader tubes, said coupler body having a coupler body longitudinal axis extending between a first coupler body end and a second coupler body end to define a coupler body length, each coupler body end surrounding and defining a pair of diametrically opposing, transverse coupler body apertures adapted to align with said retainer tube apertures; and means for stiffening said trench shield spreader; and means for securing said coupler body within each of said spreader tubes.

5. The coupler of claim 4 wherein said means for securing comprises two retainer pins, one each of said retainer pins adapted to cooperate with said opposing pair of retainer tube apertures and said pair of coupler body apertures of one of said two adjacent spreader tubes to affix said coupler body in a predetermined longitudinal position within each of said spreader tubes.

6. The coupler of claim 5 wherein said one each of said retainer pins further comprises a retainer pin bar extending between a proximate first pin end and a distal second pin end, said second pin end surrounding and defining a transverse pin keeper duct;

a retainer pin head disposed on said first pin end; and a pin keeper adapted removably to be journaled within said pin keeper duct.

* * * * *